US005397095A

United States Patent [19]

Jeffrey

[11] Patent Number: 5,397,095

[45] Date of Patent: Mar. 14, 1995

[54] MODULAR BUILDING SYSTEM

[76] Inventor: Alfred S. Jeffrey, 19154 NW. 67th Pl., Miami, Fla. 33015

[21] Appl. No.: 34,465

[22] Filed: Mar. 19, 1993

[51] Int. Cl.[6] ..... E04G 11/02; E04G 11/12

[52] U.S. Cl. ..... 249/28; 249/35; 249/39; 249/189; 249/194; 249/195; 249/196; 249/211

[58] Field of Search ..... 425/26, 27, 28, 210, 425/192, 194, 195, 196, 35, 50, 39, 209, 211, 18, 189

[56] References Cited

U.S. PATENT DOCUMENTS

| | | | |
|---|---|---|---|
| 775,666 | 11/1904 | Shute et al. . | |
| 854,098 | 5/1907 | Mann . | |
| 860,479 | 7/1907 | Ingersoll . | |
| 1,164,352 | 12/1915 | Jackson . | |
| 1,383,732 | 7/1921 | Lisowski . | |
| 1,400,751 | 12/1921 | Kuert | 248/39 |
| 1,461,426 | 7/1923 | Lisowski | 249/26 |
| 1,462,989 | 7/1923 | Spelshouse . | |
| 2,185,860 | 1/1940 | McAlpine . | |
| 2,887,756 | 5/1959 | Brechel . | |
| 3,797,800 | 3/1974 | Loy . | |
| 3,847,341 | 11/1974 | Stickler | 249/39 |
| 3,853,452 | 12/1974 | Delmonte | 249/27 |
| 4,210,304 | 7/1980 | Mannina | 247/27 |
| 4,790,508 | 12/1988 | Henderson et al. . | |
| 5,009,387 | 4/1991 | Scott et al. . | |
| 5,044,601 | 9/1991 | Miller | 249/194 |
| 5,205,944 | 4/1993 | Taylor | 249/195 |

FOREIGN PATENT DOCUMENTS

| | | | |
|---|---|---|---|
| 3211882 | 10/1983 | Germany | 249/194 |

*Primary Examiner*—Khanh Nguyen
*Attorney, Agent, or Firm*—Sughrue, Mion, Zinn, Macpeak & Seas

[57] ABSTRACT

A modular building system for constructing the frame of a structure. Standardized foundation forms, vertical forms, and tie beam forms are attached to each other. The vertical forms are hinged so as to be capable of defining a corner of any angle. Cover plates are selectively inserted into the tie beam forms so as to define a reception recess which corresponds to the size of a roof truss being used. The various forms can be attached to each other with a minimal amount of labor.

12 Claims, 6 Drawing Sheets

MODULAR BUILDING SYSTEM

BACKGROUND OF THE INVENTION

1. Field of the Invention

The subject invention relates to a modular system for building various structures. In particular, the subject invention is a modular building system wherein standardized forms can be used to build the frame of a structure with a minimal amount of parts and labor.

2. Description of the Related Art

Conventionally, houses and other structures have been constructed from a wooden frame and either bricks or various types of siding. While wood is readily available, it requires a great deal of labor to cut the wood to the proper size and assemble the frame. It is well known to utilize prefabricated frame portions for building a structure. These frame portions are constructed of wood, or other materials, at a centralized facility and shipped to the construction site where the various frame portions are assembled into a frame. This method does reduce costs somewhat because the labor can be accomplished more efficiently at the centralized facility than at the construction site. However, a great deal of labor is still involved in making and assembling the prefabricated frame portions. In fact, other than the relocation of some labor to a more efficient facility, prefabricated building techniques vary little from other conventional techniques.

The high cost of labor over recent years has thus contributed greatly to the rising cost of homes and other structures. Inflated housing costs have forced home buyers to allocate limited resources to satisfy the down payment requirements of lenders. Accordingly, the rate of foreclosures has risen drastically. This has resulted in even more stringent down payment requirements which forces home buyers to spread their finances even thinner in order to proffer the required down payment. Of course, this contributes to a cycle wherein housing is increasingly unobtainable for many people.

SUMMARY OF THE INVENTION

In view of the above, it is an object of the invention to provide a modular building system with which a structure can be built with a minimal amount of labor.

It is a further object of the invention to provide a modular building system which is suitable for building structures of various sizes and shapes.

It is still a further object of the invention to provide a modular building system which utilizes only a small amount of standardized forms.

In order to achieve the objectives above, the invention is a modular building system which utilizes standardized foundation forms for constructing a foundation, standardized vertical forms, and standardized tie beam forms. The various forms can be easily attached to each other to build a desired structure. The vertical forms are hinged so as to be capable of defining a corner of any desired angle. Cover plates of various sizes can be coupled to the tie beam forms to define a desired space for receiving joist rafters of various sizes. Accordingly, structures of various shapes and sizes can be built from a small amount of materials and with minimal labor.

BRIEF DESCRIPTION OF THE DRAWINGS

Preferred embodiments of the invention will be described below with reference to the attached drawings in which.

DETAILED DESCRIPTION OF THE PREFERRED EMBODIMENTS

Figure 1:
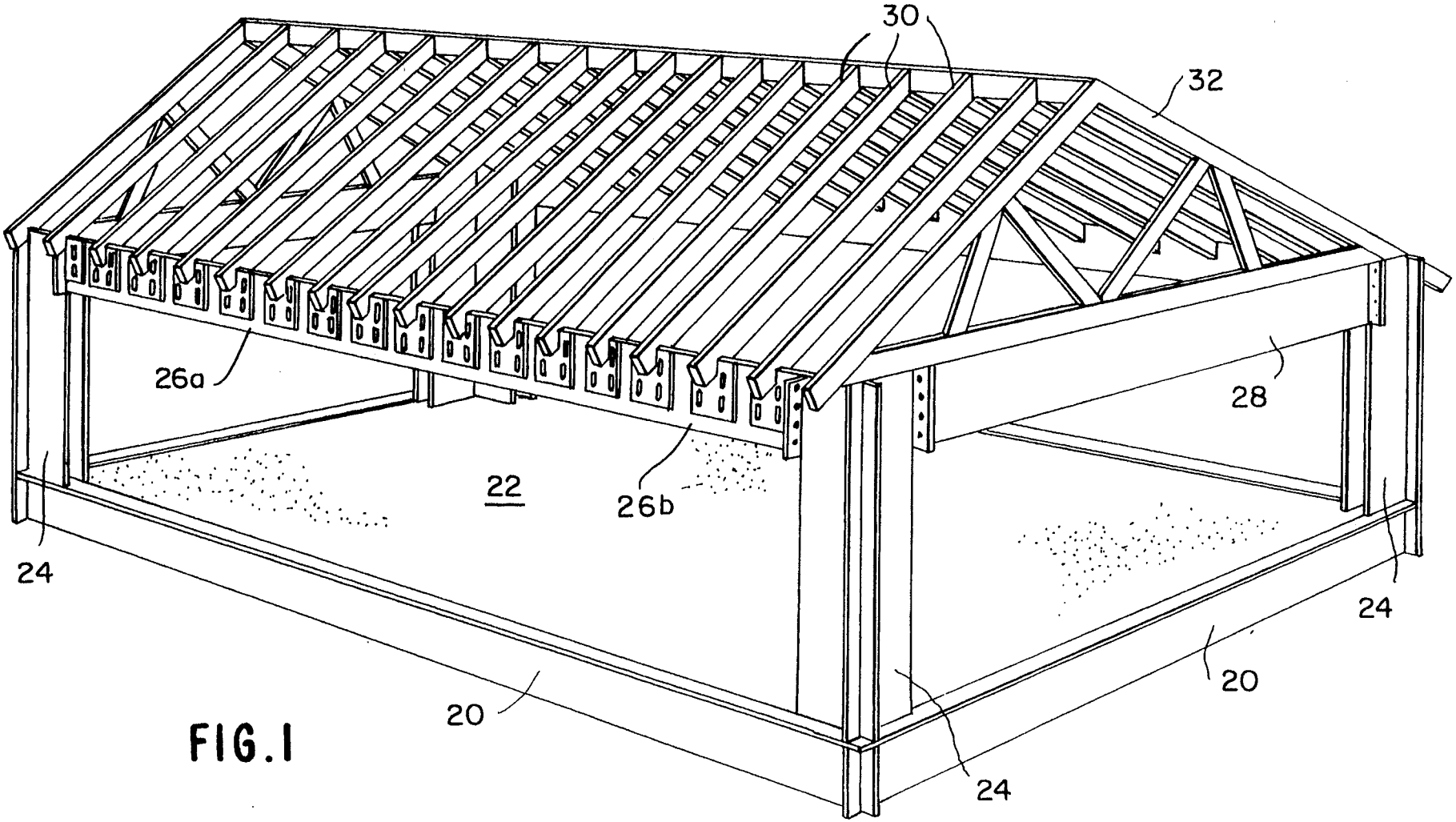
FIG. 1 illustrates a structure according to a first preferred embodiment of the invention.

FIG. 1 illustrates a frame for a structure according to a first preferred embodiment of the invention. Slab edge forms 20 are set in the ground and attached to each other so as to define an area for pouring concrete slab 22. In this embodiment, slab edge forms 20 are continuous pieces however, slab edge forms 20 can each be constructed of more than one form which are attached to each other in a manner which will be described below. Vertical forms 24 extend from corners defined by slab edge forms 20.

Tie beam forms 26*a* and 26*b* extend between upper portions of vertical forms 24 along the length of the structure and end forms 28 extend between upper portions of vertical forms 24 along the width of the structure. Roof trusses 30 (only 3 of which are indicated) extend across the structure between tie beam forms 26. Finally, an end truss 32 is disposed along the top of each end form 28. End trusses 32 and roof trusses 30 can be attached in a known manner at the peak of the frame.

Figure 6A:
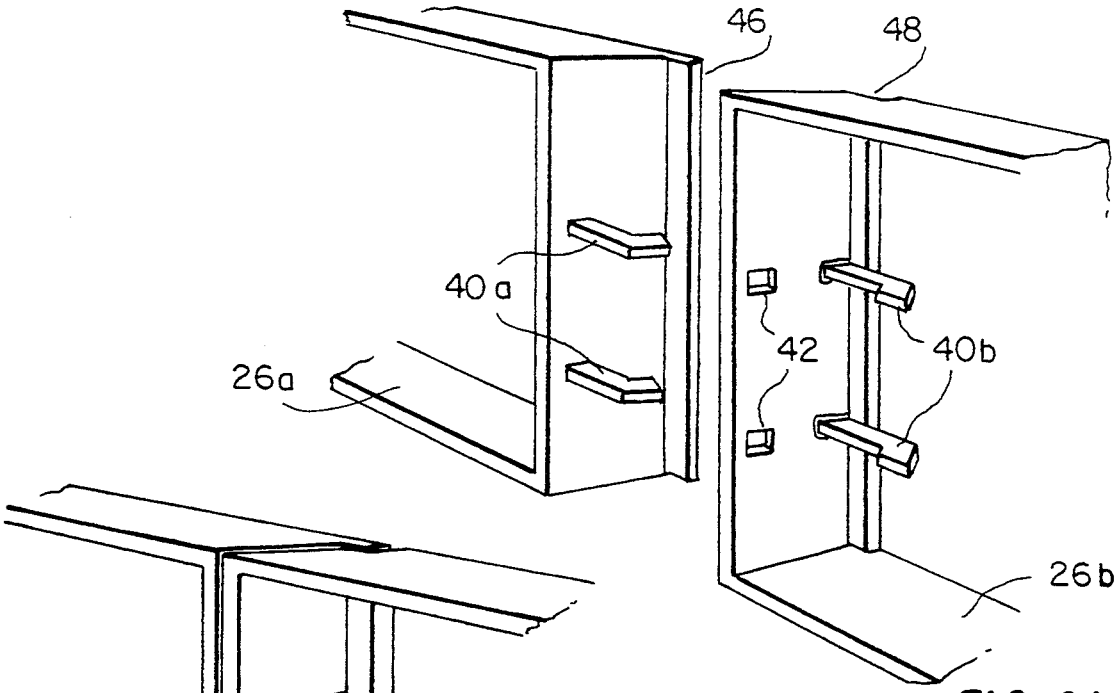
FIGS. 6A, 6B and 6C illustrate an arrangement for attaching the various forms to each other.
Figure 6B:
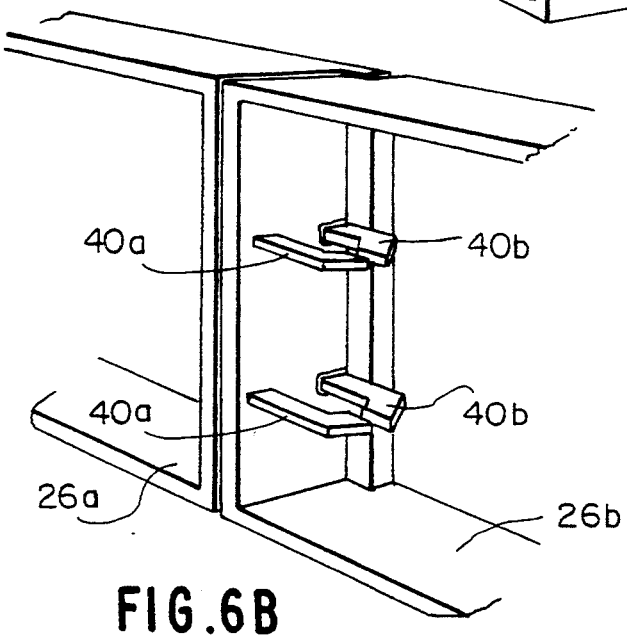
Figure 6C:
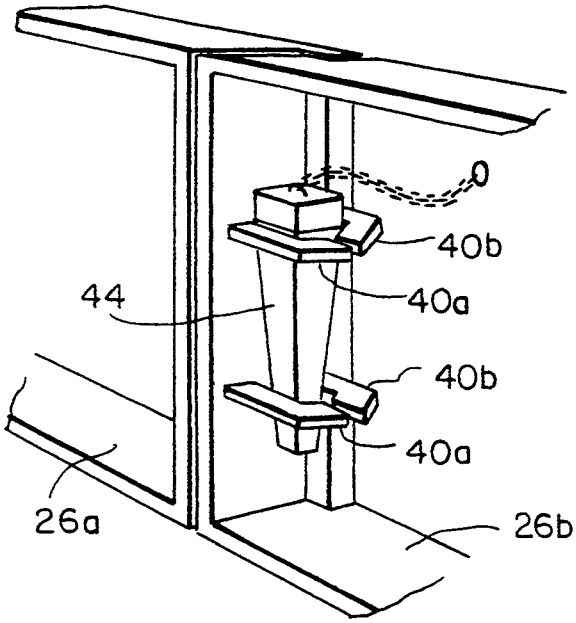

The various forms can be secured to each other with bolts or other conventional fasteners. However, in the first preferred embodiment, the forms are secured to each other utilizing the wedge locking arrangement illustrated in FIGS. 6A–6C. In particular, FIGS. 6A–6C illustrate an arrangement for securing tie beam form 26*a* to tie beam form 26*b* end to end. Of course, this arrangement can be utilized for attaching any of the slab edge forms 20, tie beam forms 26 and vertical forms 24 to each other as desired.

As illustrated in FIG. 6A, tie beam form 26*a* has generally L-shaped projections 40*a* formed on an outer end surface thereof. Tie beam form 26*b* also has L-shaped projections 40*b* formed on an inside end surface thereof. Also, holes 42 are formed through the end surface of tie beam form 26*b*. When the end surfaces of tie beam forms 26*a* and 26*b* are placed against each other, projections 40*a* extend through holes 42 so as to be positioned in opposed relationship to projections 40*b*, as illustrated in FIG. 6B.

With reference to FIG. 6C, wedge 44 can now be driven through apertures defined by projections 40*a* and 40*b* so as to secure the end faces of tie beam frames 26*a* and 26*b* to each other. A stepped portion 46 can be formed on one of tie beam frames 26*a* and 26*b* and a cooperating recessed portion 48 can be formed on the other thereof so as to prevent lateral relative movement of tie beam forms 26*a* and 26*b* after attachment to one another (see FIG. 6A). Also, wedge 44 can be chained, or otherwise secured to tie beam form 26b so as to always be readily available. The arrangement described above, allows the various forms to be properly attached to one another and precisely aligned with a minimal amount of labor and very few tools. Also, this arrangement does not require any threads or other components which can be easily damaged.

Figure 5A:
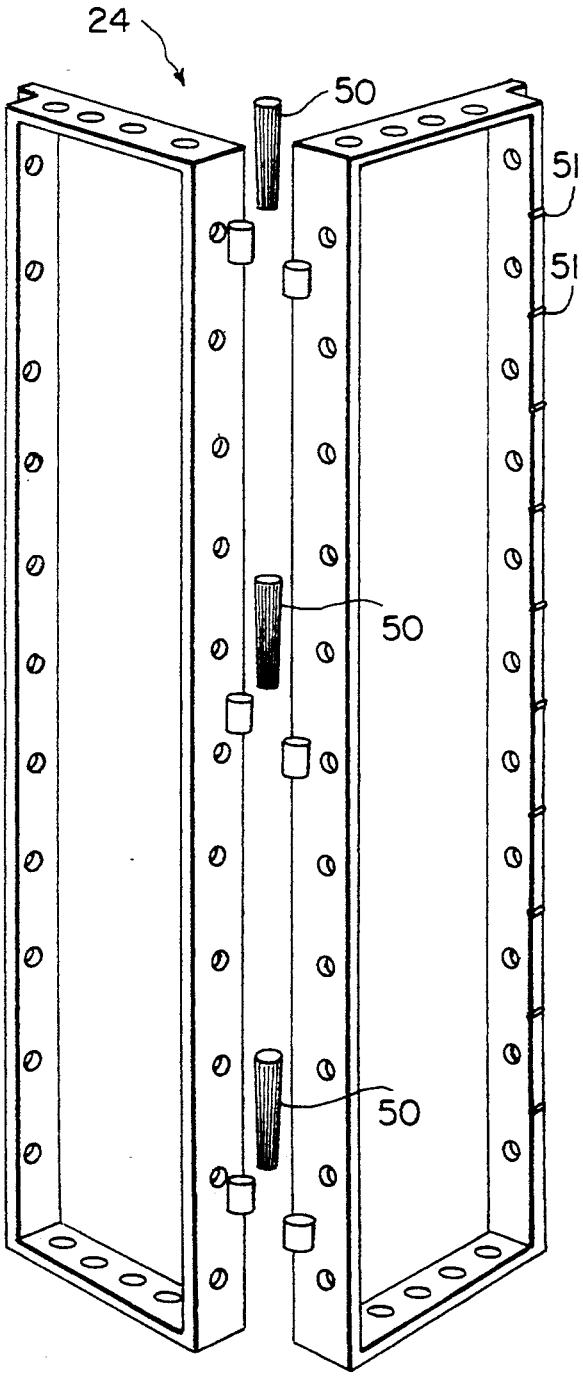
FIG. 5A is an exploded view of a vertical form.
Figure 5B:
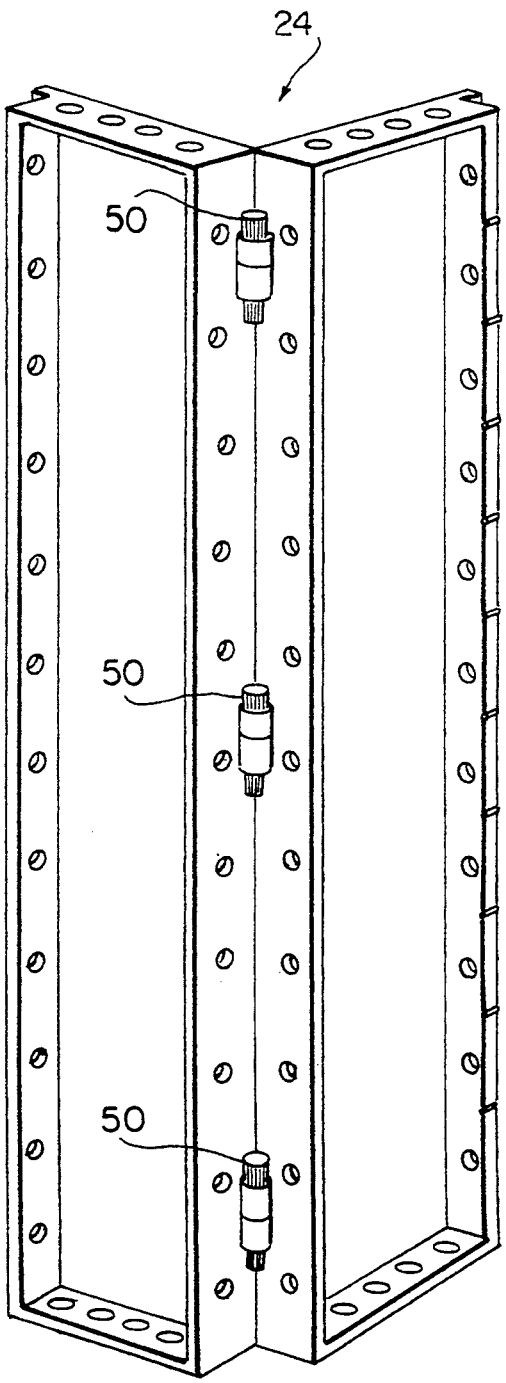
FIG. 5B illustrates a vertical form after assembly.

FIGS. 5A and 5B illustrate vertical form 24 in detail. Each vertical form 24 is constituted of two halves which are joined by a hinge. Accordingly, vertical forms 24 can define a corner of a frame structure which has virtually any angle. During assembly, the two halves are set so as to define the desired angle (see FIG. 5A) and tapered pins 50 are inserted into the hinges to hold the halves together (see FIG. 5B). Recesses are formed on the inside surface of the hinges to cooperate with splines formed on pins 50 so as to allow vertical form 24 to be incrementally fixed at various angles. In addition, slots 51 (two of which are indicated) are formed incrementally along vertical sides of vertical forms 24. Slots 51 can be used for aligning masonry along the structure. A string can be stretched between Corresponding slots 51 so as to provide an additional guide for masonry. Also, lips may be integrally or separately formed on vertical forms 24 to define the thickness of plaster and to aid in alignment of window jambs.

Figure 3:
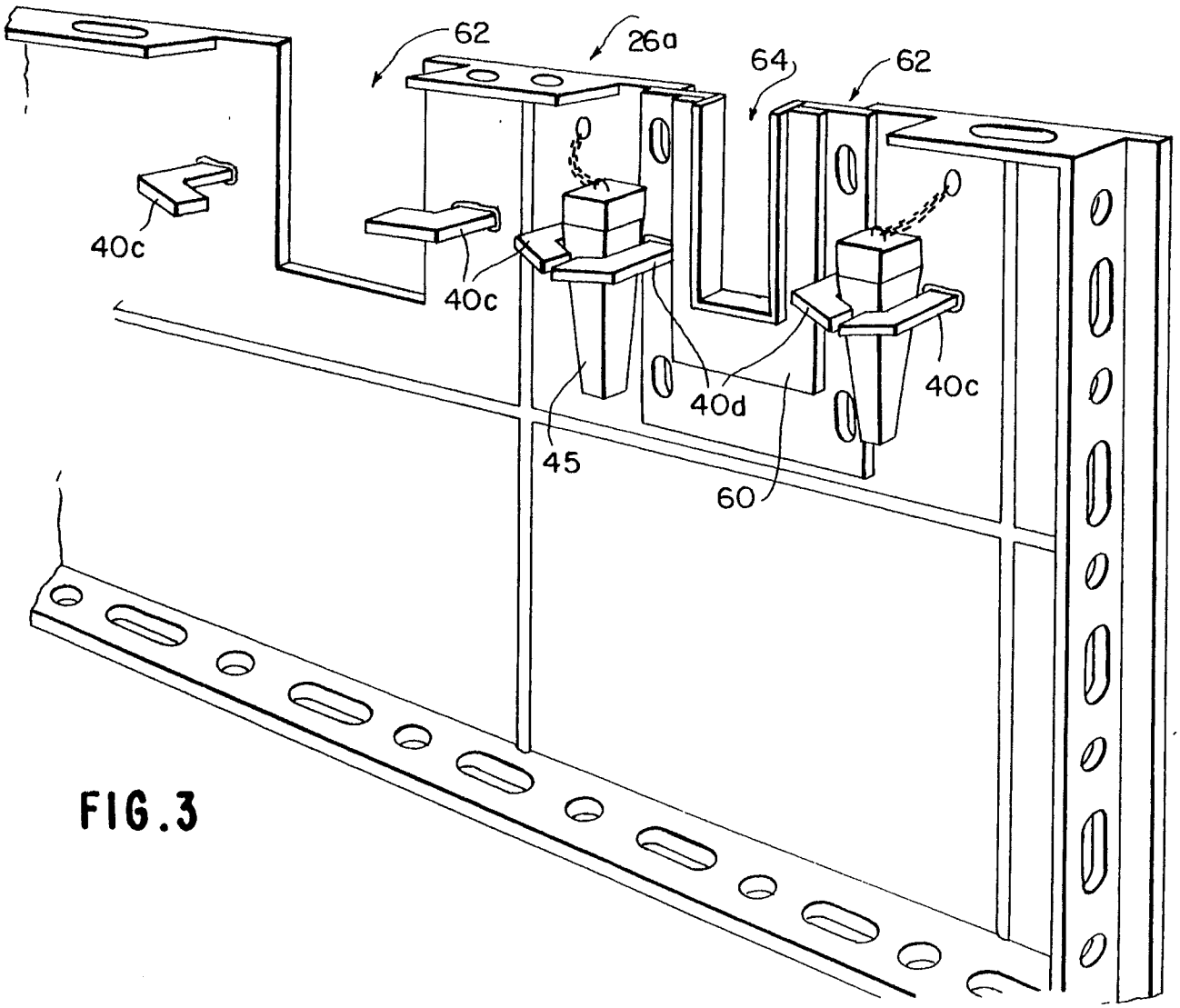
FIG. 3 illustrates a cover plate attached to the tie beam form.
Figure 4A:
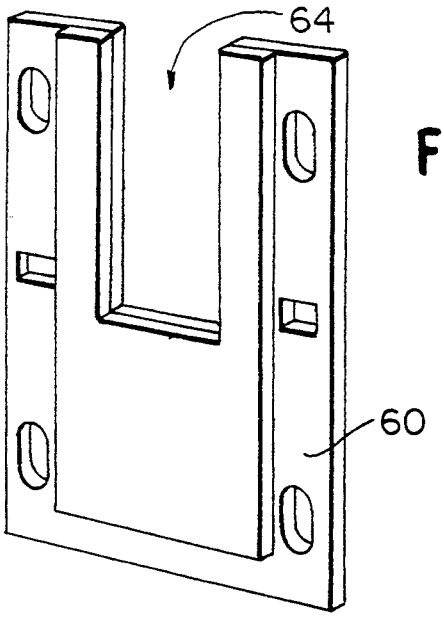
FIGS. 4A, 4B and 4C illustrate various sizes of cover plates.
Figure 4B:
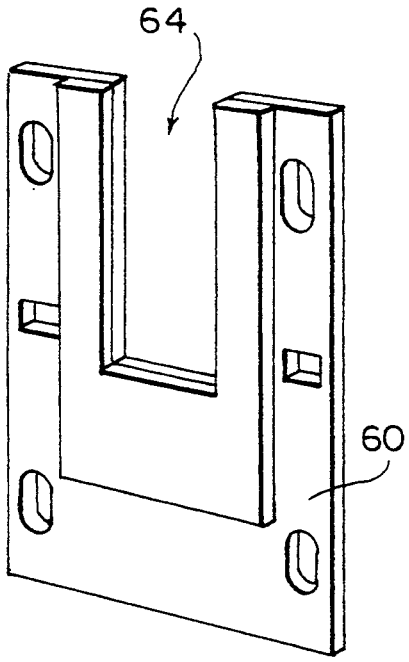
Figure 4C:
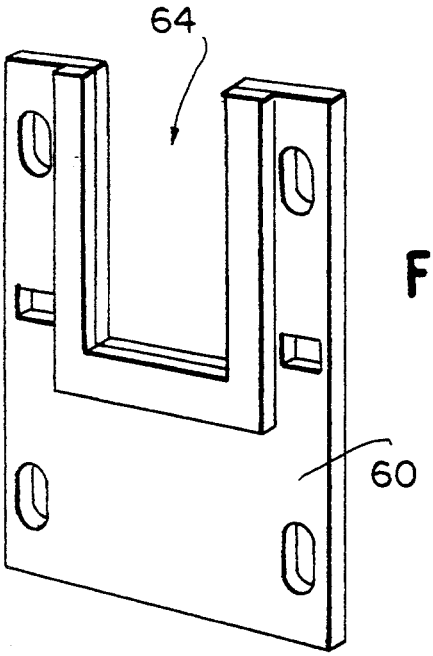

FIG. 3 illustrates tie beam form 26a in detail. Of course, tie beam form 26b is similar in construction. A cover plate 60 is inserted into each notch 62 formed along tie beam form 26a. Cover plates 60 of various sizes can be constructed in advance. Specifically, cover plate 60 can be constructed in advance to define a reception recess 64 which is of a desired size for accepting the joist rafter to be utilized in roof trusses 30 (see FIG. 1). Accordingly, tie beam form 26a can be utilized in conjunction with various sizes of joist rafters simply by placing the proper sized cover plate 60 in notch 62. Cover plates 60 can be secured to tie beam frame 26a by virtue of bolts, or the like. However, in the first preferred embodiment, cover plates 60 have L-shaped projections 40d formed thereon and tie beam frame 26a has L-shaped projections 40c formed thereon. Wedge 45 can be driven into an aperture defined by projections 44c and 44d so as to secure cover plate 60 to tie beam form 26a. Wedge 45 can be identical to wedge 44 and projections 40c and 40d can be identical to projections 40a and 40b respectively to allow even greater standardization of parts and assembly procedures. FIGS. 4A–4C illustrate cover plates 60 having tie beam receiving recesses 64 of various sizes.

Figure 2:
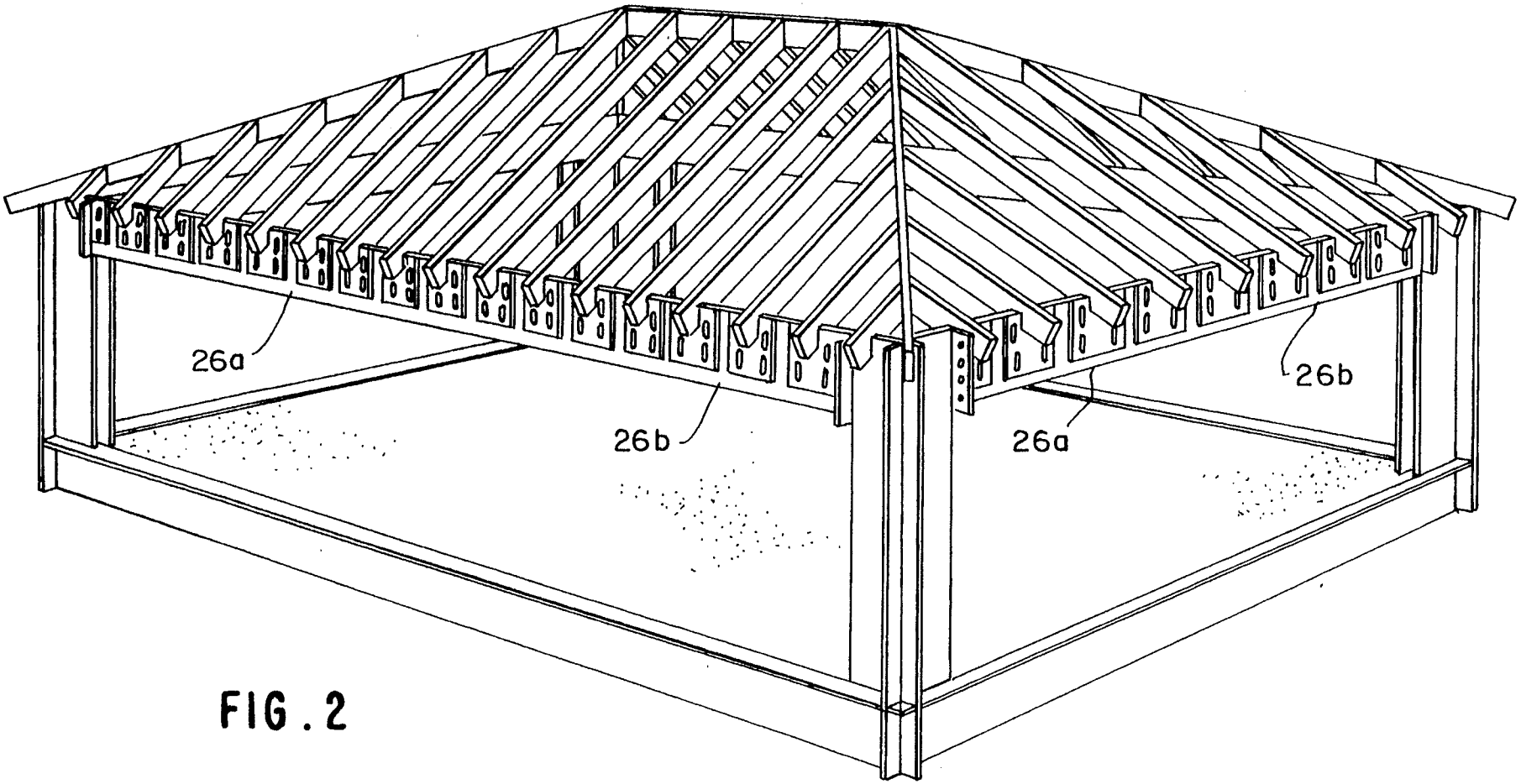
FIG. 2 illustrates a structure according to a second preferred embodiment of the invention.

FIG. 2 illustrates a second embodiment of the invention wherein tie beam forms 26a and 26b are utilized all around the frame and the need for end forms (FIG. 1) is obviated. Otherwise, the second preferred embodiment is similar to the first preferred embodiment.

The present invention allows a frame for a structure to be constructed with very little labor by utilizing different standardized parts. Accordingly, a structure built from the invention can be constructed at a significantly lower cost than with conventional methods.

The invention has been described through preferred embodiments. However, various modifications can be made without departing from the scope of the invention as defined by the appended claims.

What is claimed is:

1. A building system for constructing a structure frame, comprising:

a foundation;

vertical forms which extend vertically from said foundation and which define corners of said structure frame, each of said vertical forms comprising a vertically extending hinge portion and two vertically extending corner portions which are connected to each other through said hinge portion;

tie beam forms which extend in a horizontal direction from upper end portions of adjacent ones of said vertical forms, said tie beam forms having a plurality of notches defined in an upper portion thereof;

a cover plate disposed over each of said notches, said cover plate having a reception recess formed therein, said reception recess being superposed over said notch so as to define an open area having a predetermined size;

roof trusses having lower ends which are received in a respective one of said open areas, said roof trusses having a cross-sectional size which corresponds to said predetermined size.

2. A building system for constructing a structure frame as claimed in claim 1 wherein said hinge portions comprise of at least one hinge member, said hinge member comprising:

a cylindrical projection disposed on an edge of each of said corner portions; and a pin inserted through the cylindrical portions.

3. A building system for constructing a structure frame as claimed in claim 2 wherein said pins are conical.

4. A structure frame as claimed in claim 2, said hinge member further comprising:

spline projections formed on said pin; and recesses formed inside said cylindrical projections, said recesses being configured so as to engage with said spline projections when said pin is inserted through said cylindrical projections thereby fixing the relative angular position of said corner portions.

5. A building system for constructing a structure frame as claimed in claim 1, further comprising means for coupling said cover plates to said tie beam forms.

6. A building system for constructing a structure frame as claimed in claim 5, wherein said coupling means comprises:

a flange portion formed on each of said cover plates so as to engage with a respective reception surface of said tie beam forms, said reception surface being defined around each of said notches;

at least one first projection extending from each of said flange portions;

at least one second projection extending from each of said reception surfaces at a position which corresponds to a respective one of said at least one first projections;

a peg inserted into each space defined between respective ones of said first projection, said second projection and said reception surface.

7. A building system for constructing a structure frame as claimed in claim 6, wherein said first and second projections are L-shaped.

8. A building system for constructing a structure frame as claimed in claim 1 wherein said tie beam forms comprise first and second tie beam forms which attached end to end by an attaching device, said attaching device, said attaching device comprising:

at least one first projection formed on an outer face of an end portion of each of said first tie beam forms;

at least one second projection formed on an inner surface of an end portion of each of said second tie beam forms;

said end portion of said second tie beam forms having at least one hole formed therein, said first projections extending through a respective one of said holes os as to be positioned in opposition to a respective one of said second projections; and a peg inserted into each space defined between respective ones of said first projections, said second projections and said inner surfaces.

9. A building system for constructing a structure frame as claimed in claim 8 wherein said first and second projections are generally L-shaped.

10. A tie beam form which extends in a horizontal direction from upper end portions of adjacent vertical forms of a structure frame, said vertical forms being fixed to a foundation at lower end portions thereto, said tie beam form having a plurality of notches defined in an upper portion thereof, said tie beam comprising:

a cover plate disposed over each of said notches, each said cover plate having a reception, recess formed therein, said reception recess being superposed over said notch so as to define an open area having a predetermined size.

11. A tie beam form as claimed in claim 10 wherein said tie beam form comprises first and second tie beam forms which are attached end to end by an attaching device, said attaching device comprising:

at least one first projection formed on an outer face of an end portion of each of said first tie forms members;

at least one second projection formed on an inner surface of an end portion of each of said second tie beam forms;

said end portion of said second tie beam forms having at least one hole formed therein, said first projections extending through a respective one of said holes so as to be positioned in opposition to a respective one of said second projections; and a peg inserted into each space defined between respective ones of said first projections, said second projections and said inner surfaces.

12. A tie form as claimed in claim 11 wherein said first and second projections are generally L-shaped.

* * * * *